United States Patent [19]

Bell

[11] Patent Number: 4,469,307

[45] Date of Patent: Sep. 4, 1984

[54] CONNECTOR BRACKET FOR AN ENGINE-LIFTING WINCH

[76] Inventor: Douglas E. Bell, 8311 Roanoke Ave., Takoma Park, Md. 20912

[21] Appl. No.: 440,466

[22] Filed: Nov. 9, 1982

[51] Int. Cl.[3] ..... B25B 25/00; B21F 9/00

[52] U.S. Cl. ..... 254/199; 248/163.2; 248/165; 254/227; 254/389

[58] Field of Search ..... 254/199, 217, 218, 227, 254/334, 336, 335, 338, 389; 248/165, 163 A

[56] References Cited

U.S. PATENT DOCUMENTS

| | | | |
|---|---|---|---|
| 111,725 | 2/1871 | Cady | 254/218 |
| 714,554 | 11/1902 | Augustus | 248/165 X |
| 1,214,104 | 1/1917 | Wingire | 254/334 |

FOREIGN PATENT DOCUMENTS

| | | | |
|---|---|---|---|
| 813312 | 9/1951 | Fed. Rep. of Germany | 248/165 |
| 241069 | 2/1946 | Switzerland | 248/165 |

*Primary Examiner*—Stuart S. Levy
*Assistant Examiner*—Katherine Jaekel
*Attorney, Agent, or Firm*—Sughrue, Mion, Zinn, Macpeak & Seas

[57] ABSTRACT

A connecting bracket for a tripod support comprises a trapezoidally shaped base plate, two hollow cylindrically shaped receptacles mounted on the same side of the base plate at the inclining ends thereof, and an elongated metal rod receptacle mounted on the other side of the base plate at the center thereof. The rod comprises an upper leg-engaging portion and a lower hook-shaped portion. The tripod support formed thereby can be used to support a winch assembly as well as the object to be lifted, i.e. an automobile engine. In another embodiment, the two cylindrical receptacles are replaced by elongated metal rods.

11 Claims, 7 Drawing Figures

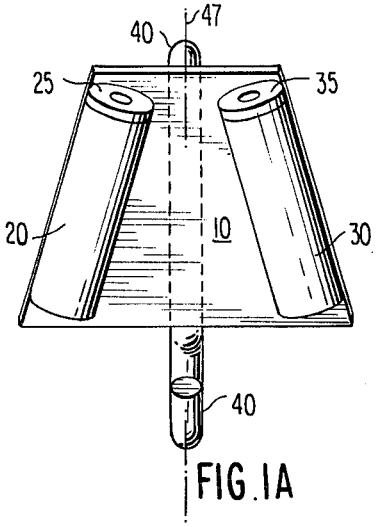
FIG. 1A
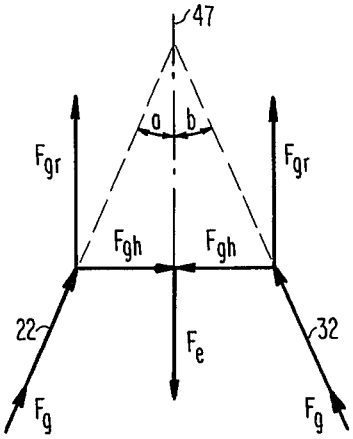
FIG. 1B
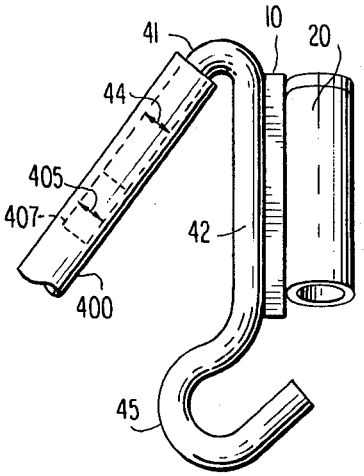
FIG. 1C
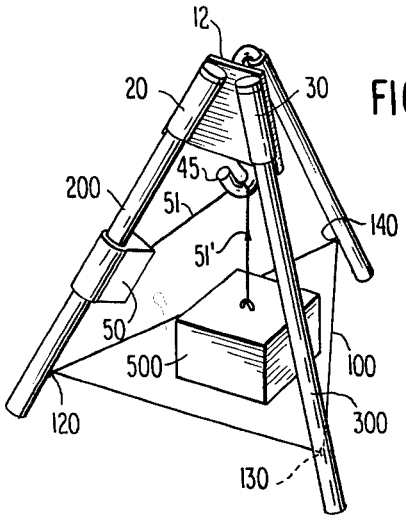
FIG. 2A
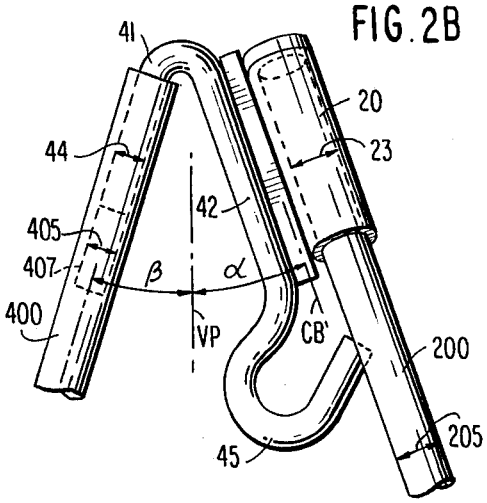
FIG. 2B
FIG. 3A
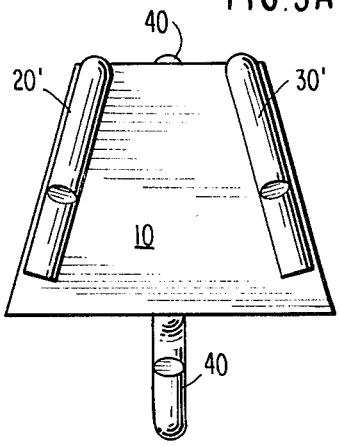
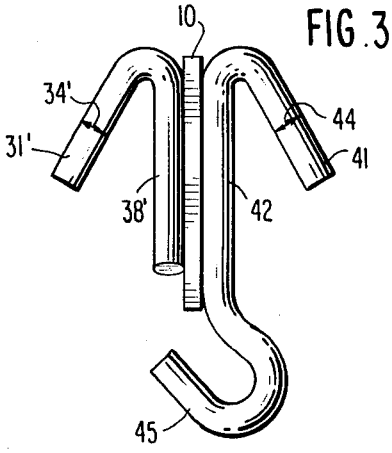
FIG. 3B

CONNECTOR BRACKET FOR AN ENGINE-LIFTING WINCH

BACKGROUND OF THE INVENTION

The present invention relates generally to the field of tripod supports, and is specifically designed to provide a connecting bracket for a low cost tripod support for an engine-lifting winch.

In general, due to the current high cost of professional automobile maintenance, many car owners have become "home mechanics" who make their own repairs. In order to effect such repairs, it is necessary from time to time for the home mechanic to completely remove the automobile engine from the chassis of the car. This is done in order to afford the repair person complete access to all parts of the engine. However, the typical home mechanic does not have facilities to complete such an engine-lifting operation. Thus, the home mechanic must either take his car to a professional repairman, or construct a crude engine-lifting structure out of the materials available to him. Typically, such home-made engine-lifting structures are highly unstable and dangerous. Accordingly, a need has developed for a suitable support structure for an engine-lifting mechanism such as a winch or other such device which can be used to lift heavy objects. Ideally, such a support would provide a stable mounting for the winch assembly, support the lifted engine during the lifting operation, and maintain the engine at a certain height above the ground while the mechanic effects his repairs.

Among the support structures developed in the prior art which are suitable for providing such a winch mechanism support is the common tripod. Tripod-like structures provide stable support for such mechanically sensitive (and relatively lightweight) devices as cameras and survey equipment. However, since the stability of a tripod is due to the fact that the weight of the supported device is evenly distributed between three ground-engaging legs, it would seem that a tripod-like structure would be an ideal support for an engine-lifting winch.

U.S. Pat. No. 737,765 (issued Sept. 1, 1903 to G. Olsen) discloses a grubbing (or winch) machine supported on such a tripod-like structure. In Olsen, two of the three tripod legs are mounted flush to a set of horizontal support plates, forming an "A" frame construction. The third leg is pivotally connected to the other two legs, and the planes of both the plates and the third leg are at acute angles with respect to the vertical plane of the earth. The grubbing machine is mounted between the support plates, and the grubbing line therefrom extends downward from the pivotal connection. The tripod support structure of Olsen possesses several disadvantages which render it impractical for use in the specific engine-lifting winch application of the present invention. The main disadvantage inherent in the tripod support structure of Olsen is that it is not collapsible. In other words, it is preferable that the tripod support be collapsible (or readily taken apart) in the manner of the common sawhorse which is constructed of a plurality of wooden planks interconnected by steel connecting brackets. The "unitary" construction of the Olsen tripod support makes it both too costly and too hard to store for the typical homeowner. Thus, it is desirable to provide a tripod support structure which has a connecting bracket for interconnecting the three legs of the tripod, such that the tripod may be readily taken apart and stored.

U.S. Pat. No. 3,779,497 (issued Dec. 18, 1973 to Webber) discloses a tripod and a clamp therefor in which the clamp comprises a plurality of cylindrical receptacles which are all angled both from the vertical and with respect to each other. The clamp comprises a triangularly shaped upper plate with a recess in its lower surface. A triangularly shaped lower plate is disposed within the recess of the upper plate. The corners of both the upper plate and the lower plate are provided with semi-cylindrical recesses into which the tripod legs are inserted. The plates are further provided with a centrally disposed screw-and-wing-nut arrangement which tightly secures the tripod legs within the cylindrical receptacles. The bottom portion of the screw comprises a vertical hook.

The connector construction of Webber presents several disadvantages in an engine-lifting winch application. Webber is chiefly concerned with providing a stable support, not above eye-level, for photographic mechanisms and would not be practicable for or capable of supporting substantial weight which is to be lifted a vertical distance of several feet. Another disadvantage of the tripod clamp as disclosed in Webber is that it comprises several parts - the triangularly-shaped upper plate, the eyebolt, the release spring, the collar or washer, the recess-engaging lower plate, and the wing nut. If any one of these several pieces is somehow lost or broken, the entire device is rendered inoperable.

Also, the tripod clamp as disclosed in Webber depends for rigidity and stability solely upon the limited clamping effect afforded by the threaded bolt and wing nut. It is further noted that another disadvantage of the Webber disclosure is that the wing nut must, to accomplish the desired clamping effect, draw the first and second members toward one another. The said drawing action of the wing nut is opposed and possibly jeopardized or reduced as soon as the load to be lifted becomes suspended from the hook or eye. Moreover, the tripod clamp as disclosed in Webber, owing to the plurality and complexity of its various constituent parts, is expensive to manufacture. Another disadvantage of the tripod clamp disclosed by Webber is that the practical length of the legs is quite limited owing to the necessity that the user have access to the several parts during assembly and for adjustment; thus, in an engine lifting application, for example, where the engine must be lifted several feet above the ground level, the wing nut would be well beyond the reach of the user. Accordingly, it would be advantageous to provide a unitary connecting bracket for a tripod support which is: adaptable to a large variety of leg diameters and lengths; easy and safe to erect and use owing to its integrated, one-piece construction, and; not dependent for its rigidity or stability, upon any clamp or clamping action.

SUMMARY OF THE INVENTION

It is thus an object of the present invention to provide a connecting bracket for a tripod, the connecting bracket being of a unitary construction.

It is a further object of the present invention to provide a tripod supporting bracket for an engine-lifting winch which is light in weight, compact, inexpensive to manufacture, simple to assemble and disassemble, regardless of leg length employed, and easy to store.

The foregoing and other objects of the present invention are realized by providing a connecting bracket for the legs of a tripod-supported engine-lifting winch which is of unitary construction. In a first embodiment of the present invention, the connecting bracket comprises a plate with a pair of cylindrical receptacles on one side and an elongated member on the other side. The cylindrical receptacles are mounted flush to the surface of the plate in an "A" type configuration (that is, the axis of the receptacles intersect at a point in space above the top portion of the plate). The elongated member comprises a lower hook portion disposed below the bottom portion of the plate and an upper leg-engaging portion extending downward from the top portion of the plate. When the legs of the tripod are mounted within the connector, the base plate and the elongated member are at approximately equal angles with respect to the vertical plane of the earth. In a second embodiment of the present invention, the connecting bracket comprises a plate with a pair of rod-shaped members at either end on one side and a single rod-shaped member in a central position on the other side. In both the first and second embodiments of the present invention, the winch assembly may be attached to one of the tripod legs. To enhance the stability of the tripod, a support wire may be connected between the ground contacting ends of the tripod legs, to further assure that the legs will not slip outward in response to downward pressure.

BRIEF DESCRIPTION OF THE DRAWING

The structures and functions of the present invention will become more apparent upon a detailed description of the preferred embodiments thereof. In the description to follow, reference will be made to the accompanying drawings, in which:

FIG. 1A is a front view of a bracket according to a first embodiment of the present invention;

FIG. 1B is a force diagram of the first embodiment of the present invention;

FIG. 1C is a side view of the bracket according to the first embodiment of the present invention;

FIG. 2A is a perspective view of a tripod structure according to the first embodiment of the present invention;

FIG. 2B is a side view of the tripod structure of the first embodiment of the present invention;

FIG. 3A is a front view of the second embodiment of the present invention; and

FIG. 3B is a side view of the second embodiment of the present invention.

DETAILED DESCRIPTION OF THE PREFERRED EMBODIMENT

Before describing the overall tripod support of the present invention, a detailed discussion of the tripod connecting bracket of the present invention will be made with reference to FIGS. 1A–1C.

In FIG. 1A, trapezoidally shaped base plate 10 is provided on one surface with twin cylindrical receptacles 20 and 30. On its other surface is provided an elongated rod-shaped member 40. The cylindrical receptacles 20 and 30 are further provided with donut-shaped end plates 25 and 35 at their upper ends. Receptacles 20 and 30 are equally and oppositely inclined with respect the vertical center line 47 of the base plate 10; that is, with reference to FIG. 1B, axes 22 and 32 of the cylindrical receptacles 20 and 30 intersect at equal acute angles a and b with respect to vertical center line 47. As shown in FIG. 1B, the equal and opposite inclination of the cylindrical receptacles 20 and 30 permits the force $F_e$ due to a freestanding lifted engine to be balanced by a ground-resisting force $F_g$ which acts through receptacles 20 and 30 so that a substantial horizontal component $F_{gh}$ serves to balance the tripod structure while the force $F_e$ is counterbalanced through vertical components $F_{gr}$.

The base plate 10 is further provided with an elongated member 40, which will be described with reference to FIG. 1C. As shown in FIG. 1C, elongated member 40 comprises an upper leg-engaging portion 41, an intermediate vertical portion 42, and a lower hook portion 45. The lower hook portion 45 is used to secure the lifted object in a stationary position once the lifting operation has been completed. The leg-engaging component 41 is fitted within a cylindrical tripod leg 400. The cylindrical tripod leg 400 must have an inner hollow portion 407 having a diameter at least slightly greater than the outside diameter 44 of the leg-engaging means 41. The hollow portion 407 of tripod leg 400 may be either continuous (i.e., the tripod leg is a pipe) or may extend a discrete distance into the cylindrical tripod leg 400, as shown.

FIG. 2A shows a perspective view of the overall tripod structure of the first embodiment of the present invention. The tripod legs 200 and 300 are inserted into cylindrical receptacles 20 and 30, and the leg-engaging portion 41 of elongated member 40 is inserted into tripod leg 400. The tripod legs 200, 300 and 400 are further interconnected by line 100 at points 120, 130 and 140 proximate their ground-engaging ends. A winch assembly 50 is attached to any one of these three legs, and winch line 51 is slung through the hook-shaped portion 45 such that it falls within the pyramidal area defined by the three tripod legs. With reference to FIG. 2B, note that tripod legs 200 and 300 may have any diameter 205 and 305 which is less than the inside diameter 23 and 33 of the cylindrical receptacles 20 and 30, respectively. Further, as previously described with reference to FIG. 1E, the tripod leg 400 is provided with an aperture having a diameter 405 which is slightly larger than the diameter 44 of the leg engaging means 41. As is apparent from the side view of FIG. 2B, the plane CB of the entire connecting bracket is inclined at an angle $\alpha$ with respect to the vertical plane VP of the earth. The axis of the leg engaging means 41 (or the axis of the tripod leg 400) is inclined at an angle $\beta$ with respect to the vertical plane VP. For maximum stability, these angles of inclination are equal and opposite, although they are not limited thereto. Referring back to FIG. 2A, the winch device 50 is actuated to impart an upward force 51' to an engine or other heavy object 500. Once the heavy object 500 reaches hook 45 of elongated member 40, the object 500 can be detached from the winch line 51 and attached to hook 45.

A second embodiment of the connector bracket of the present invention will now be described with reference to FIGS. 3A and 3B.

In FIG. 3A, base plate 10 is provided with a plurality of elongated members 20', 30' and 40. Elongated members 20' and 30' are analogous in structure to the elongated member 40 as previously described, and are disposed on the base plate 10 similarly to the disposition of cylindrical receptacles 20 and 30. With reference to FIG. 3B, member 30' comprises both a leg-engaging means 31' and a force offset member 38' for connecting member 30' to the base plate 10. In the second embodiment of the present invention, the tripod legs 200, 300 and 400 must have inner apertures of diameters greater than the diameters of the leg-engaging means 24', 34' and 44.

In summary, a connecting bracket for an engine-lifting winch support has been disclosed which is safe, inexpensive to manufacture, easy and quick to assemble and disassemble, and easy to store. The tripod legs may be of any length, provided that they are roughly equivalent. The tripod legs may consist of any material such as wood or metal, although it is preferred that the tripod legs comprise a plurality of metal pipes or tubes, since such pipes or tubes are readily available everywhere and fairly inexpensive. Since neither the cylindrical receptacles nor the leg-engaging means connect with the tripod legs by means of flush contact with the outer perimeter of the tripod legs, the tripod legs can vary greatly both in outer and inner diameter. While the present invention has been disclosed in the context of an engine-lifting application, it is to be understood that the present invention is not limited to such a use, but can also be utilized to provide a tripod support for a wide variety of objects or object-lifting mechanisms, of whatever size or scale.

It is to be understood that modifications can be made to the present invention as described above without departing from the spirit and scope of the appended claims.

What is claimed is:

1. A tripod, comprising:

a base plate having two sides, first and second receptacles, said receptacles being mounted on one of said sides of said base plate in spaced apart relation, an elongated member having upper and lower ends, said member being mounted on the other of said sides of said base plate at a central portion thereof;

first, second and third tripod legs each having first and second ends, said first ends of said first and second legs being connected to said first and second receptacles, respectively, and said first end of said third leg being connected to said upper end of said elongated member, said elongated member comprising a rod member bent at said upper end to form leg engaging means, and bent at its lower end to form object supporting means, at least said third leg including a tubular portion for receiving a portion of said upper end of said rod member.

2. The tripod as recited in claim 9, wherein said lower end of said elongated member comprises an object-engaging hook.

3. The tripod as recited in claim 2, wherein said tripod legs describe a pyramidal area in space within which an object is to be vertically displaced, said tripod further comprising:

lifting means for applying a vertical force to said object, said lifting means being connected to one of said tripod legs and having a resilient connector extending through said object-engaging hook for connecting said object to said lifting means.

4. The tripod as recited in claim 9, further comprising connecting means for interconnecting said second ends of said tripod legs.

5. The tripod as recited in claim 9, wherein said base plate has a vertical center line, and wherein said receptacles are at equal and opposite angles with respect to said center line.

6. A connecting bracket for a tripod support of the type having three legs secured at their upper ends by respective leg-engaging means, said connecting bracket comprising:

a base plate having two sides, each of said sides having two ends and a central portion therebetween;

a first leg-engaging means mounted on one side of said base plate at one end thereof;

a second leg-engaging means mounted on said one side of said base plate at the other end thereof; and a third leg-engaging means mounted on the other side of said base plate at said central portion thereof, said third leg-engaging means comprising an elongated rod member bent at its upper end to form an engagement portion, and having at its lower end a load bearing member.

7. The connecting bracket as recited in claim 6, wherein said first and second leg-engaging means are hollow and cylindrical in shape for receiving a respective two of said tripod legs therein, and said engagement portion of third leg-engaging means being insertable into an end of a third of said legs.

8. The connecting bracket as claimed in claim 6, wherein said first and second leg-engaging means each comprise a metal rod insertable into an end of a respective one of said legs.

9. A tripod, comprising:

a base plate having two sides, first and second tripod leg receiving means, said leg receiving means being mounted on one of said sides of said base plate in spaced apart relation, an elongated rod member having an upper portion for engaging a tripod leg and a lower portion forming a load bearing member, and mounted on the other of said sides of said base plate at a central location thereof;

first, second and third tripod legs each having first and second ends, said first ends of two of said legs being received in said leg receiving means, and said first end of said third leg including means for receiving therein said upper end of said elongated rod member.

10. A tripod, comprising:

a base plate having two sides, first and second tripod leg receiving means, said leg receiving means being mounted on one of said sides of said base plate in spaced apart relation, an elongated rod member having an upper portion for engaging a tripod leg and a lower portion forming a load bearing member, and mounted on the other of said sides of said base plate at a central location thereof;

first, second and third tripod legs respectively connected to said leg receiving means and said upper end of said elongated rod member, at least one of said legs having a tubular end section for receiving said upper end of said elongated rod member.

11. A tripod, comprising:

a base plate having two sides, first and second leg mounting means mounted on one of said sides of said base plate in spaced apart relation, and a third leg mounting means mounted at a central location on the other side of said base plate, first, second and third tripod legs each being at least partially tubular, said first, second and third leg mounting means comprising rod portions having bent ends receivable into tubular end portions of said first, second and third tripod legs, said third leg mounting means further comprising a substantially linear member including an elongated distil end forming a load bearing member.

* * * * *